US006162956A

United States Patent [19]

Berlowitz et al.

[11] Patent Number: 6,162,956

[45] **Date of Patent: *Dec. 19, 2000**

[54] STABILITY FISCHER-TROPSCH DIESEL FUEL AND A PROCESS FOR ITS PRODUCTION

[75] Inventors: Paul J. Berlowitz, E. Windsor, N.J.; Robert J. Wittenbrink, Baton Rouge, La.

[73] Assignee: Exxon Research and Engineering Co, Florham Park, N.J.

[ * ] Notice: This patent is subject to a terminal disclaimer.

[21] Appl. No.: 09/135,850

[22] Filed: Aug. 18, 1998

[51] Int. Cl.[7] ..... C10L 1/16; C07C 7/20; C10G 25/00

[52] U.S. Cl. ..... 585/14; 585/1; 208/27

[58] Field of Search ..... 208/27; 585/14, 585/1

[56] References Cited

U.S. PATENT DOCUMENTS

| | | | |
|---|---|---|---|
| 3,847,561 | 11/1974 | Feldman | 44/406 |
| 5,011,593 | 4/1991 | Ware et al. | 208/213 |
| 5,689,031 | 11/1997 | Berlowitz et al. | 585/734 |

FOREIGN PATENT DOCUMENTS

| | | |
|---|---|---|
| 2050405 | 12/1995 | Romania . |
| 1785524 | 12/1992 | Russian Federation . |

*Primary Examiner*—Johann Richter
*Assistant Examiner*—J. Parsa
*Attorney, Agent, or Firm*—Jay Simon

[57] ABSTRACT

A Fischer-Tropsch derived distillate fraction is blended with either a raw gas field condensate distillate fraction or a mildly hydrotreated condensate fraction to obtain a stable, inhibited distillate fuel.

14 Claims, 2 Drawing Sheets

STABILITY FISCHER-TROPSCH DIESEL FUEL AND A PROCESS FOR ITS PRODUCTION

FIELD OF THE INVENTION

This invention relates to stable, inhibited distillates and their preparation. More particularly, this invention relates to stable, inhibited distillates, useful as fuels or as fuel blending components, in which a Fischer-Tropsch derived distillate is blended with a gas field condensate.

BACKGROUND OF THE INVENTION

Distillate fuels derived from Fischer-Tropsch processes are often hydrotreated to eliminate unsaturated materials, e.g., olefins, and most, if not all, oxygenates. The hydrotreating step is often combined with mild hydroisomerization resulting in the formation of iso-paraffins, often necessary for meeting pour point specifications for distillate fuels, particularly fuels heavier than gasoline, e.g., diesel and jet fuels.

Fischer-Tropsch distillates, by their nature, have essentially nil sulfur and nitrogen, these elements having been removed upstream of the Fischer-Tropsch reaction because they are poisons, even in rather small amounts, for known Fischer-Tropsch catalysts. As a consequence, Fischer-Tropsch derived distillate fuels are inherently stable, the compounds leading to instability, e.g., by oxidation, having been removed either upstream of the reaction or downstream in subsequent hydrotreating steps. While stable, these distillates have no inherent inhibitors for maintaining oxidative stability. Thus, upon the onset of oxidation, as in the formation of peroxides, a measure of oxidative stability, the distillate has no inherent mechanism for inhibiting oxidation. These materials may be viewed as having a relatively long induction period for oxidation, but upon initiation of oxidation, the material efficiently propagates oxidation.

The development of gas fields, i.e., where the gas is natural gas and primarily contains methane, often includes the recovery of gas field condensates, hydrocarbon containing liquids associated with the gas. The condensate normally contains sulfur but not in a form that usually acts as an inhibitor. Gas field condensates thus have relatively short induction periods but are inefficient for propagating oxidation. Thus, the condensates are often free of thiols or mercaptans which are sulfur containing anti-oxidants.

SUMMARY OF THE INVENTION

In accordance with this invention, a blended distillate, useful as a fuel or a fuel blending component, and having both stability and resistance to oxidation comprises: a Fischer-Tropsch (F-T) derived distillate and a gas field condensate distillate fraction, and wherein the sulfur content of the blend is ≧1 ppm by wt.

Figure 1:
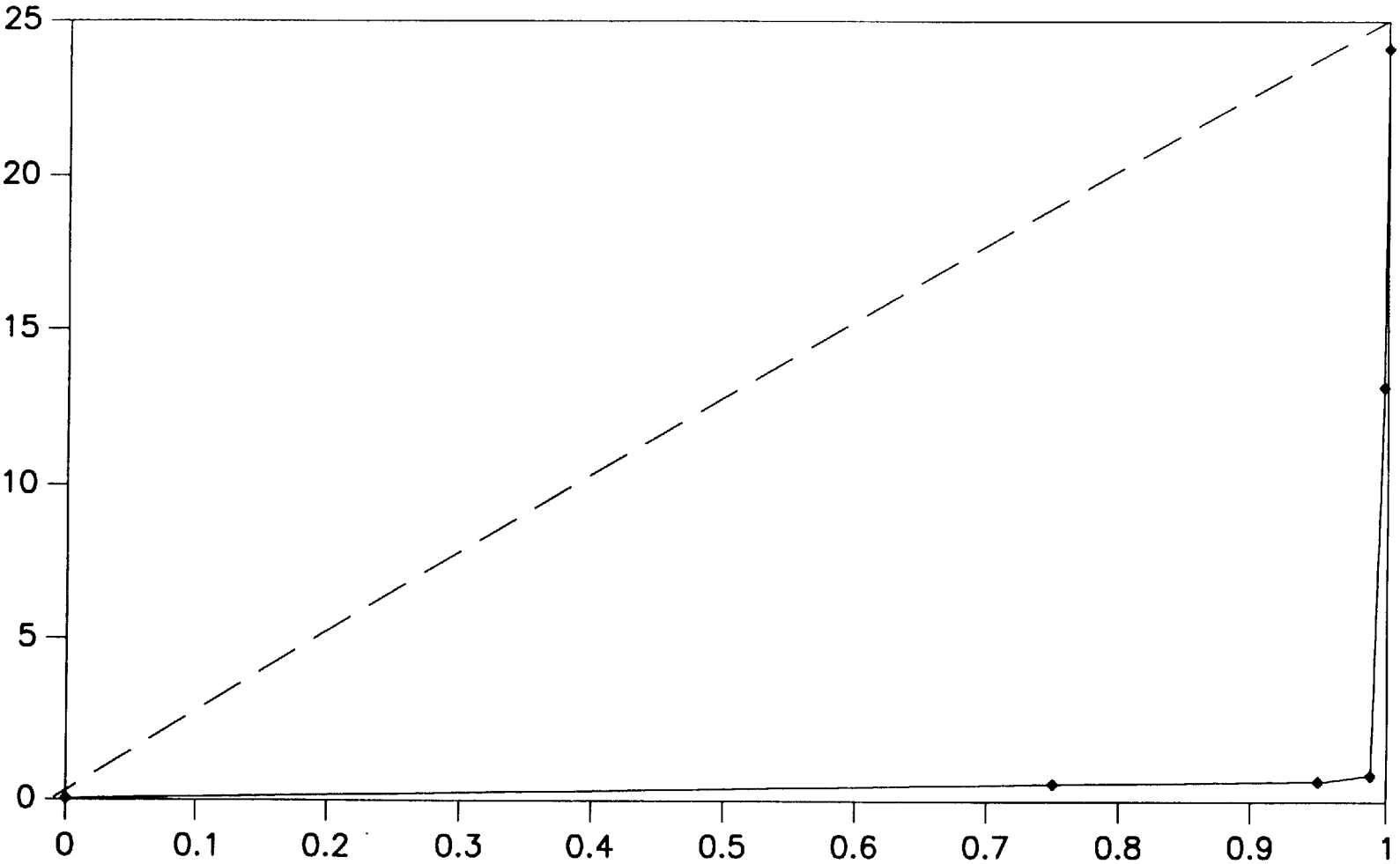
FIG. 1 shows the effect on peroxide number of adding 1% and 23% by weight of a gas field condensate to a Fischer-Tropsch derived distillate fuel.
Figure 2:
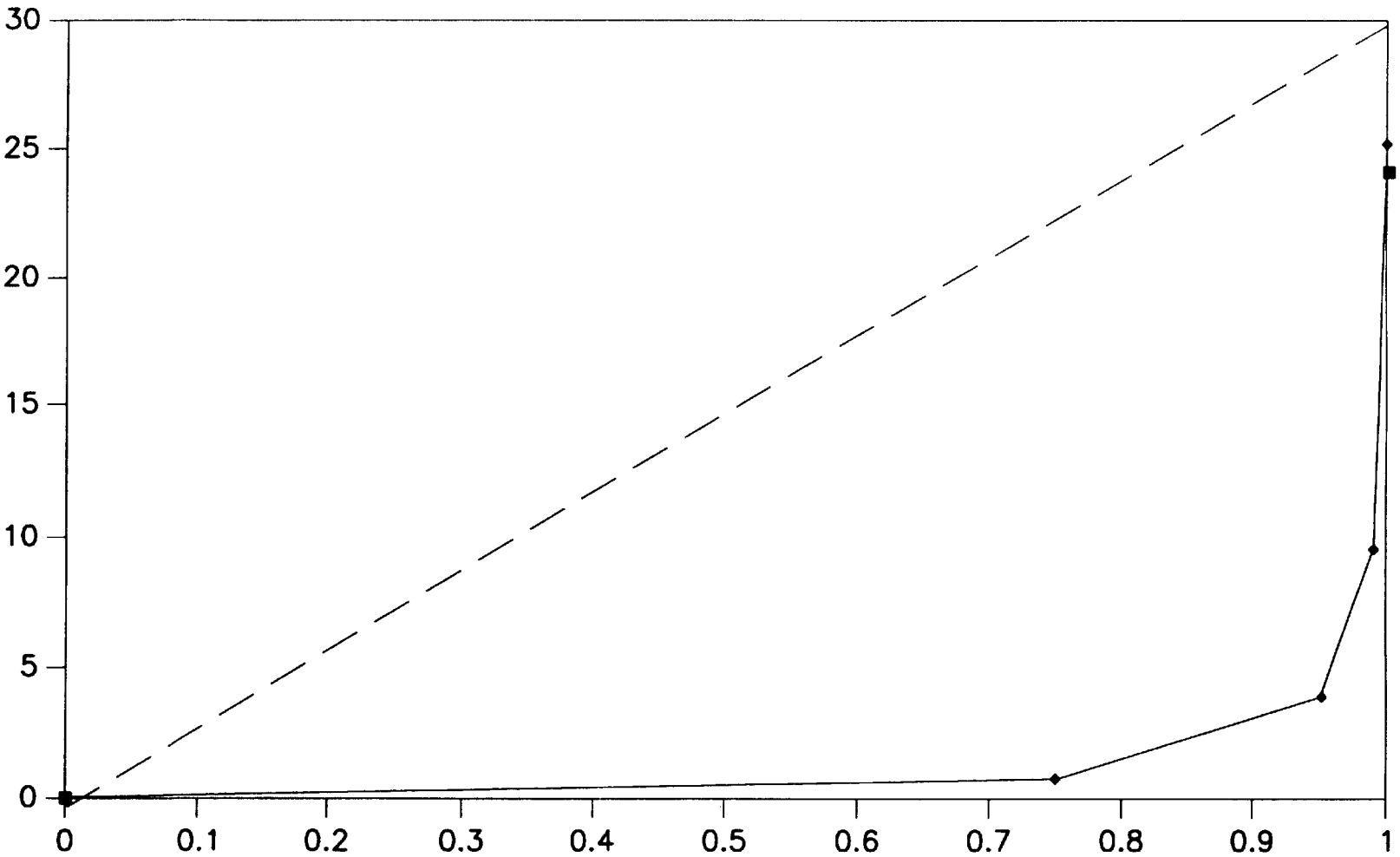
FIG. 2 shows the effect on peroxide number of adding a mildly hydrotreated gas field condensate having 393 ppm sulfur in amounts of 5% and 23% to a Fischer-Tropsch derived fuel.

In each figure the peroxide number after 28 days is shown on the ordinate and the weight fraction Fischer-Tropsch derived fuel is shown on the abscissa.

In the absence of any known effects on the addition of a relatively less stable fuel with a relatively more stable, but uninhibited fuel, one would expect the peroxide number to fall on a straight line connecting the peroxide numbers for a 100% F-T derived fuel and a 100% condensate derived fuel, shown in the drawings as a dotted line.

The data in the drawings make it abundantly clear that small amounts of gas field condensate, when added to a Fischer-Tropsch derived fuel can, and do, have a significant effect on the long term stability of the F-T derived fuel.

The distillate fraction for either the Fischer-Tropsch derived material or the gas field condensate is a $C_8$-700° F. stream, preferably comprised of a 250–700° F. fraction, and preferably in the case of diesel fuels or diesel range fuels, a 320–700° F. fraction.

The gas field condensate is preferably a distillate fraction that is essentially unconverted or stated otherwise, is in the substantial absence of any treatment materially changing the boiling point of the hydrocarbon liquids in the condensate. Thus, the condensate has not been subjected to conversion by means that may significantly or materially change the boiling point of the liquid hydrocarbons in the condensate (e.g., a change of no more than about ±10° F., preferably no more than about ±5° F. The condensate, however, may have been de-watered, desalted, distilled to the proper fraction, or mildly hydrotreated, none of which significantly effects the boiling point of the liquid hydrocarbons of the condensate.

In one embodiment, the gas field condensate may be subjected to hydrotreating, e.g., mild hydrotreating, that reduces sulfur content and olefinic content, but does not significantly or materially effect the boiling point of the liquid hydrocarbons. Thus, hydrotreating, even mild hydrotreating is usually effected in the presence of a catalyst, such as supported Co/Mo, and some hydrocracking may occur. In the context of this invention, unprocessed condensate includes condensate subjected to mild hydrotreating which is defined as hydrotreating that does not materially change the boiling point of the liquid hydrocarbons and maintains sulfur levels of >10 ppm, preferably ≧20 ppm, more preferably ≧30 ppm, still more preferably ≧50 ppm. The sulfur is essentially or primarily in the form of thiophene or benzothiophene type structures; and there is a substantial absence of sulfur in either the mercaptan or thiol form. In other words, the forms of sulfur that act as oxidation inhibitors are not present in sufficient concentrations in the condensate to provide inhibiting effects.

The result of this mixture is a distillate fraction, preferably a 250–700° F. fraction and more preferably a 320–700° F. that is both stable and resistant to oxidation. Oxidation stability is often determined as a build up of peroxides in the sample under consideration. While there is no standard for the peroxide content of fuels, there is general acceptance that stable fuels have a peroxide number of less than about 5, preferably less than about 3, and desirably less than about 1.0.

The Fischer-Tropsch process is well known and preferably utilizes a non-shifting catalyst such as cobalt or ruthenium or mixtures thereof, preferably cobalt, and more preferably a promoted cobalt, particularly where the promoter is rhenium. Such catalysts are well known and described in U.S. Pat. Nos. 4,568,663 and 5,545,674.

Non-shifting Fischer-Tropsch reactions are well known and may be characterized by conditions that minimize the formation of $CO_2$ by-products. These conditions can be achieved by a variety of methods, including one or more of the following: operating at relatively low CO partial pressures, that is, operating at hydrogen to CO ratios of at least about 1.7/1, preferably about 1.7/1 to 2.5/1, more preferably at least about 1.9/1 and in the range 1.9/1 to about 2.3/1, all with an alpha of at least about 0.88, preferably at least about 0.91; temperatures of about 175°–240° C., preferably about 180° C.–220° C., using catalysts comprising cobalt or ruthenium as the primary Fischer-Tropsch catalysis agent. A preferred process for conducting the Fischer-Tropsch process is described in U.S. Pat. No. 5,348,982.

The products of the Fischer-Tropsch process are primarily paraffinic hydrocarbons, although very small amounts of olefins, oxygenates, and aromatics may also be produced. Ruthenium catalysts produce paraffins primarily boiling in the distillate range, i.e., $C_{10}$–$C_{20}$; while cobalt catalysts generally produce more heavier hydrocarbons, e.g., $C_{20}$+.

The diesel fuels produced from Fischer-Tropsch materials generally have high cetane numbers, usually 50 or higher, preferably at least 60, and more preferably at least about 65.

Gas field condensates may vary in composition from field to field, but the condensates useful as fuels will have some similar characteristics, such as: a boiling range about 250–700° F., preferably about 320–700° F.

Distillate boiling range fractions of condensate may vary widely in properties; essentially in the same way that distillate boiling range fractions of crude oils may vary. These fractions, however, may have at least 20% paraffins/iso-paraffins and as high as 50% or more or 60% or more of paraffins/isoparaffins. Aromatics are typically less than about 50%, more typically less than about 30%, and still more typically less than about 25%. Oxygenates are typically less than about 1%.

The F-T derived distillate and the gas field condensate distillate may be mixed in wide proportions, and as shown above, small fractions of condensate can significantly effect the peroxide number of the blend. Thus, blends of 1–75 wt % condensate with 99–25 wt % F-T derived distillate may readily be formed. Preferably, however, the condensate is blended at levels of 1–50 wt % with the F-T derived distillate, more preferably 1–40 wt %, still more preferably 1–30 wt %.

The stable blend of F-T derived distillate and gas field condensate may then be used as a fuel, e.g., diesel or jet, and preferably a fuel heavier than gasoline, or the blend may be used to upgrade or volume enhance petroleum based fuels. For example, a few percent of the blend can be added to a conventional, petroleum based fuel for enhancing cetane numbers, typically 2–20%, preferably 5–15%, more preferably 5–10%; alternatively, greater amounts of the blend can be added to the petroleum based fuel to reduce sulfur content of the resulting blend, e.g., about 30–70%. Preferably, the blend of this invention is mixed with fuels having low cetane numbers, such as cetane of less than 50, preferably less than 45.

The blend of gas field condensate and Fischer-Tropsch distillate will preferably have a sulfur level of at least 1 ppm by weight; more preferably at least about 3 ppm, still more preferably at least about 4 ppm. The blend may contain up to about 150 ppm S, preferably less than 100 ppm sulfur, still more preferably <50 ppm, even more preferably <30 ppm, and yet more preferably <10 ppm.

Fischer-Tropsch derived distillates useful as fuels can be obtained in a variety of ways known to those skilled in the art, e.g., in accordance with the procedures shown in U.S. Pat. No. 5,689,031 or allowed U.S. application Ser. No. 798,376, filed.

Additionally, many papers have been published in which F/T derived distillate fuels are obtained by hydrotreating/hydroisomerizing all or appropriate fractions of Fischer-Tropsch process products and distilling the treated/isomerized product to the preferred distillate fraction.

Fischer-Tropsch distillates useful as fuels or fuel blending components are generally characterized as being:

>80 wt %, preferably >90 wt %, more preferably >95 wt % paraffins, having an iso/normal ratio of 0.1 to 10, preferably 0.3 to 3.0, more preferably 0.7 to 2.0; sulfur and nitrogen of less than 1 ppm each, preferably less than 0.5, more preferably less than 0.1 ppm each; ≦0.5 wt % unsaturates (olefins and aromatics), preferably ≦0.1 wt %; and less than 0.5 wt % oxygen on a water free basis, preferably less than about 0.3 wt % oxygen, more preferably less than 0.1 wt % oxygen and most preferably nil oxygen. (The F-T distillate is essentially free of acids.)

The iso paraffins of a F-T derived distillate are mono-methyl branched, preferably primarily mono-methyl breached, and contain small amounts of cyclic paraffins, e.g., cyclo hexanes. Preferably, the cyclic paraffins of the F-T distillate are not readily detectable by standard methods, such as gas chromatography.

The following examples serve to illustrate but not to limit in any way this invention. Table A details the composition of the raw gas field condensate utilized in the examples (col. I) and the several hydrotreated (HT) condensates (col. II, III, and IV). The new condensate and the hydrotreated condensate are essentially free of mercaptans and thiols.

TABLE A

| Sample Description | Raw Condensate | Low Severity HT | Low Severity HT | Moderate Severity HT |
|---|---|---|---|---|
| Boiling Range | 320–700° F. | 320–700° F. | 320–700° F. | 320–700° F. |
| Gravity, ° API | 43.1 | 43.3 | 43.3 | 43.9 |
| Flash Point, ° F. | | | | 129.2 |
| Sulfur, wt % | 0.194 | 0.0366 | 0.0393 | 0.0023 |
| Total Nitrogen, wppm | 26.4 | 15.68 | 12.20 | |
| Hydrogen, wt % (NMR) | 14.36 | 14.44 | 14.68 | 14.52 |
| Predicted Cetane by IR | 47.2 | | | 48.8 |
| Sulfur Typing by GC-SCD | | | | |
| Non-Thiophenes | 203 | N/D | N/D | N/D |
| thiophenes | 187 | 66 | 69 | N/D |
| Benzothiophenes | 482 | 78 | 85 | N/D |
| Dibenzothiophenes | 81 | 32 | 31 | N/D |
| Dibenzothiophene Alone | 37 | 16 | 18 | N/D |
| Beta-dibenzothiophenes | 69 | 23 | 24 | N/D |
| 4-Methyldibenzothiophene | 22 | 9 | 10 | N/D |
| Dibeta-dibenzothiophenes | 25 | 9 | 10 | N/D |
| 4,6-dimethyldi-benzothiophene Alone | 9 | 3 | 3 | N/D |
| 3&4 Ring Unassigned | 49 | 8 | 13 | N/D |
| 1&2 Ring Unassigned | 554 | N/D | N/D | N/D |
| Total Identified Sulfur | 1650 | 218 | 239 | |

EXAMPLE 1: STABILITY OF FISCHER-TROPSCH DERIVED DISTILLATE FUELS

A Fischer-Tropsch diesel fuel produced by the process described in U.S. Pat. No. 5,689,031 was distilled to a nominal 250–700° F. boiling point encompassing the distillate range. The material was tested according to a standard procedure for measuring the buildup of peroxides: first a 4 oz. sample was placed in a brown bottle and aerated for 3 minutes. An aliquot of the sample is then tested according to ASTM D3703-92 for peroxides. The sample is then capped and placed into a 60° C., oven for 1 week. After this time the peroxide number is repeated, and the sample is returned to the oven. The procedure continues each week until 4 weeks have elapsed and the final peroxide number is obtained. A value of <1 is considered a stable distillate fuel.

The Fischer-Tropsch fuel described above was tested 3 times: fresh, after 10 weeks of aging in air on the bench at room temperature, and after 20 months of aging in a sealed (air containing) can in refrigeration. The results are shown below in Table 1.

TABLE 1

| Fuel | Initial peroxide no. (0 days) | Final peroxide no. (28 days) |
|---|---|---|
| Fresh | 0.00 | 0.30 |
| Aged 10 weeks | 0.00 | 7.50 |
| Aged 20 months | 0.00 | 58.94 |

This data show that an initially stable fuel sample undergoes degradation with time. Thus, a fuel having no initially detectable peroxides, readily builds up peroxides upon storage at 60° C. under mild oxidation promoting conditions as in the test.

EXAMPLE 2: STABILITY OF F-T FUEL WITH ADDITION OF SEVERELY TREATED CONDENSATE

The sample of F-T fuel from Example 1 which had been aged for 20 months was combined with a gas field condensate which had been hydrotreated (shown in column IV of Table A) to a sulfur content of <25 ppm by X-ray diffraction (not evident or detectable by gas chromatography) and distilled to a 250–700° F. fraction. The blend was made with 77% of the F-T fuel and 23% of the hydrotreated condensate.

The blended fuel and a sample of the hydrotreated condensate, by itself, was tested as in Example 1. Results are summarized in Table 2.

TABLE 2

| Fuel Sample | Initial peroxide no. | Final peroxide no. |
|---|---|---|
| Aged Fuel of Ex. 1 | 0.00 | 58.94 |
| Condensate (<25 ppm S) | 0.11 | 0.51 |
| Blend (77:23) | 0.16 | 34.16 |

This data show that the addition of severely hydrotreated condensate to the Fischer-Tropsch derived diesel fuel had little or no effect on the stability of the F/T fuel, even though the condensate itself did not exhibit significant peroxide buildup. Note that the value of 34.16 is close to the expected value, e.g., from averaging (58.94)(0.77)+(°)(0.23)~4.

EXAMPLE 3: ADDITION OF RAW CONDENSATE TO UNSTABLE F-T FUELS

The unstable F/T fuel of Example 1, that was aged 20 months in refrigeration was blended with an unprocessed, i.e., no hydrotreating or other conversion process, raw gas condensate shown in Column I, of Table A with ~2500 ppm S at levels of 1% and 23% condensate. Results for both the 1% and 23% condensate blends showed no (0.0) increase in peroxide number from an initial value of 0.0 at the start of the test. The results are shown in Table 3 below.

TABLE 3

| Fuel Sample | Initial Peroxide no. | Final Peroxide no. |
|---|---|---|
| F-T | 0 | 58.94 |
| raw condensate | 0 | 0 |
| 23% raw cond./77% F-T | 0.0 | 0.0 |
| 1% raw cond./99% F-T | 0.0 | 0.44 |

These data show that as little as 1% of raw condensate completely stabilizes the fuel.

EXAMPLE 4: ADDITION OF LOW SEVERITY HYDROTREATED CONDENSATE TO F-T FUEL

A low severity hydrotreated fuel, the fuel of columns II and III of Table A was blended with an F-T fuel of example 1. The results are shown in Table 4 below.

TABLE 4

| Fuel Sample | $S_1$ ppm | $S_1$ ppm as blended | Initial peroxide no. | Final peroxide no. | % F-T/% Condensate |
|---|---|---|---|---|---|
| F-T | 0 | 0 | 0 | 58.94 | 100/0 |
| mildly HT Condensate | 393 | 20 | 0 | 0.76 | 95/5 |
| col. III, Table A | 393 | 20 | 0 | 1.03 | 95/5 |
| mildly HT Condensate | 393 | 4 | 0 | 0.84 | 99/1 |
| col. III, Table A | 393 | 90 | 0.24 | 0.47 | 77/23 |
| mildly HT Condensate | 366 | 84 | 0.27 | 1.21 | 77/23 |
| col. II Table A | | | | | |

The data again show that good oxidation inhibition as reflected by final peroxide number, can be obtained with about 1% condensate. The experiment with mildly hydrotreated condensate B and 99/1 F-T/condensate blend suggests that less than 4 ppm S is required for obtaining a well inhibited fuel blend of F-T distillate and gas field condensate distillate.

A summary of the four examples shows that:

In Example 1, aging of Fischer-Tropsch fuels makes them worse, i.e., final peroxide number is high, even though their initial peroxide number is 0. Thus, the initial peroxide number of a fuel is not readily indicative of the longer term stability of that fuel.

In Example 2, a Fischer-Tropsch fuel blended with a severely hydrotreated gas field condensate, i.e., where X-ray analysis shows less than 25 ppm S, but g.c. analyses not identify any S containing compounds. The condensate is stable but the blend is no more stable than an arithmetic blend of F-T distillate fuel/condensate. Consequently, the effect of the blend is not much better, or about the same as, a dilution effect.

In Example 3, a raw condensate (not hydrotreated) provides a stable inhibited fuel blend at just 1% condensate.

In Example 4, a mildly hydrotreated gas condensate at a level of 1% in a blend with an F-T fuel provided a stable, inhibited fuel blend.

We claim:

1. A blend material useful as a distillate fuel or as a blending component for a distillate fuel comprising: (a) a Fischer-Tropsch derived distillate comprising a $C_8$-700° F. fraction, and (b) a gas field condensate distillate comprising a $C_8$-700° F. fraction, wherein the sulfur content of the blend material is ≧1 ppm by wt.

2. The blend material of claim 1 wherein the sulfur is comprised of thiophenic sulfur.

3. The blend material of claim 1 wherein the Fischer-Tropsch distillate is a 250–700° F. fraction and has a sulfur content of less than 1 ppm by wt.

4. The blend material of claim 3 wherein the condensate is selected from the group consisting of unprocessed condensate and mildly hydrotreated condensate where the boiling range of the hydrocarbons in the condensate is not materially changed.

5. The blend material of claim 4 wherein the sulfur content of the condensate is ≧10 ppm by wt.

6. The blended material of claim 4 wherein the proportion of (a) to (b) is about 99/1 to 25/75.

7. The blend material of claim 6 wherein the proportion of (b) in the blend with (a) ranges from about 1% to 40%.

8. The blended material of claim 6 further blended with a petroleum derived distillate.

9. The further blend of claim 8 wherein the blended material is about 30–70% of the further blend.

10. The blend material of claim 4 wherein the sulfur content of (a) is less than 1 ppm and the blend material contains up to about 150 ppm sulfur.

11. The blend material of claim 10 containing less than 100 ppm sulfur.

12. The blend material of claim 10 wherein the proportion of (b) is 1–30 wt %.

13. The blend material of claim 10 wherein when the proportion of (b) is 1% and a stable, inhibited fuel is obtained.

14. The blend material of claim 1 wherein the blend contains up to about 150 ppm sulfur.

* * * * *